US005934677A

United States Patent [19]

Yiu

[11] Patent Number: 5,934,677

[45] Date of Patent: Aug. 10, 1999

[54] SCORE INDICATING METHOD FOR A DART GAME

[76] Inventor: Chih-Hao Yiu, 7F-1, No. 30, Lin Sen Road, Taichung, Taiwan

[21] Appl. No.: 09/050,593

[22] Filed: Mar. 30, 1998

Related U.S. Application Data

[63] Continuation-in-part of application No. 08/778,651, Jan. 3, 1997, abandoned.

[51] Int. Cl.[6] ..... F41J 3/02

[52] U.S. Cl. ..... 273/371; 273/408

[58] Field of Search ..... 273/371, 373, 273/374, 376, 408

[56] References Cited

U.S. PATENT DOCUMENTS

| | | | |
|---|---|---|---|
| 4,415,162 | 11/1983 | Sheppard | 273/371 |
| 4,824,121 | 4/1989 | Beall et al. | 273/376 |
| 4,948,148 | 8/1990 | Danielson | 273/408 |
| 5,540,445 | 7/1996 | Lee | 273/371 |
| 5,552,758 | 9/1996 | Tobin | 273/408 X |
| 5,648,752 | 7/1997 | Alfrey | 273/371 X |
| 5,681,044 | 10/1997 | Houriet, Jr. et al. | 273/371 |
| 5,743,533 | 4/1998 | Wiles et al. | 273/371 |
| 5,755,443 | 5/1998 | Huang | 273/371 |

*Primary Examiner*—William H. Grieb
*Attorney, Agent, or Firm*—Charles E. Baxley

[57] ABSTRACT

A score indicating method for a cricket dart game may show a warning signal and a close status in a single displayer for allowing the current player to realize the scores of all of the other players without switching the screens of the displayer. The displayer includes a number of score units for indicating a number of scores each and includes three score segments in each of the score units for indicating three shots of the dart segments. The score units each further includes a warning segment for warning the other when one of the players has shot three or more times of the score. The score units each further includes a close segment for indicating a close status when all of the players have shot three or more times of the score.

2 Claims, 2 Drawing Sheets

SCORE INDICATING METHOD FOR A DART GAME

The present invention is a continuation-in-part of U.S. Pat. Ser. No. 08/778,651 Filed: Jan. 3, 1997, entitled: SCORING SYSTEM FOR DART GAMES, now abandoned.

BACKGROUND OF THE INVENTION

1. Field of the Invention

The present invention relates to a dart game, and more particularly to a score indicating method for a dart game.

2. Description of the Prior Art

Typical electrical cricket dart games comprise a dart board including a target area having a number of target segments to be shot by a dart, and a displayer for displaying the scores. The displayer may include a video display screen, liquid crystal display, electronic display or the like. The typical dart games comprise a number of different rules including "count up or count down", "301–901", "round the clock" and "cricket". For cricket or the so-called "mickey mouse", the users have to shoot three times for each of the target plates scoring from 15 to 20 and the bull. In order for scoring purposes, seven groups of light bulbs are provided in the dart board for scoring the shooting of the target plates scoring from 15 to 20 and the bull. In the begining, all of the seven groups of light bulbs are turned on. When the users shoot a target plate scoring "15", one of the group of the light bulbs scoring "15" will be turned off. The winner should first shoot and turn off all of the light bulbs. The light bulbs occupy a large volume which may increase the volume and the manufacturing price of the dart game.

A typical electrical cricket dart game is disclosed in U.S. Pat. No. 5,318,319 to Jones et al. and comprises two groups of seven light bulbs for indicating the shots of the dart segments. Jones et al. discloses two groups of seven light bulbs only in order to reduce the number of the light bulbs. The light bulbs may generate different colors for indicating different shots of the scores. U.S. Pat. No. 4,824,121 to Beall discloses another typical dart game having a number of designs for displaying the necessary information of the dart game.

However, none of the prior darts games provide a warning sign to warn the other players, and none of the prior dart games provide a close sign to indicate that all the players have shot all three shots of a particular score. The other players may still try to shoot the other unrequired score when no warning means is provided for warning the others. The prior arts also fail to disclose an electric dart game that may provide or teach or suggest a close status indicating means for indicating that the particular score has been shot by all of the players. Without the close status indicating means, the other players may still try to shoot the scores that do no good to the players. It is further to be noted that the dart games normally include about one to three displayers only. Most of the times, three or more players may simultaneously play with such dart games, such that the displayers may not show the scores of all of the players and may show the scores of about one to three of the players only. Accordingly, the current player may or may not view the scores of all of the other players and may not know how to shoot the further scores in order to close the game as soon as possible. The current player and the other players may required to depress the buttons of the dart game frequently in order to view the scores of the other players. This is inconvenient.

The present invention has arisen to mitigate and/or obviate the afore-described disadvantages of the conventional scoring systems for cricket dart games.

SUMMARY OF THE INVENTION

The primary objective of the present invention is to provide a score indicating method for cricket dart games which may be used for indicating the open status of a cricket game and for warning the other players, and for indicating the close status of a cricket game and for indicating that all the players have shot all three shots of a particular score.

In accordance with one aspect of the invention, there is provided a score indicating method for a cricket dart game, the dart game including a plurality of dart segments each representing a score, the method comprising providing a displayer, the displayer including a plurlaity of score units for indicating a plurlaity of scores each, providing three score segments in each of the score units for indicating three shots of the dart segments, indicating the shots with the score segments of the displayer, providing a warning segment in each of the score units, and indicating a warning signal to the other players with the warning segment of the displayer when a first player has shot at least three times of the score.

In accordance with another aspect of the invention, there is provided a score indicating method for a cricket dart game, the dart game provides a close segment in each of the score units, and may indicate a close signal to the other players with the close segment of the displayer when all of the players have shot at least three times of the score.

DETAILED DESCRIPTION OF THE PREFERRED EMBODIMENT

A dart game in accordance with the present invention is to provide a scoring system for a dart game. A co-pending U.S. patent was filed on Apr. 14, 1995 with the Ser. No. 08/422,247 and disclosed a scoring system for indicating the scoring of a cricket dart game with the strokes of the displayer. The application has been allowed and is taken as a reference for this application. In the co-pending U.S. patent application, no warning sign and no sign for indicating "close" and "open" are provided. Another co-pending U.S. Patent was filed on Aug. 6, 1996 with the Ser. N0. 08/692,703 and disclosed a scoring system having signs for indicating the close and the open status of the dart games. The application is also taken as a reference of the present invention.

Figure 1:
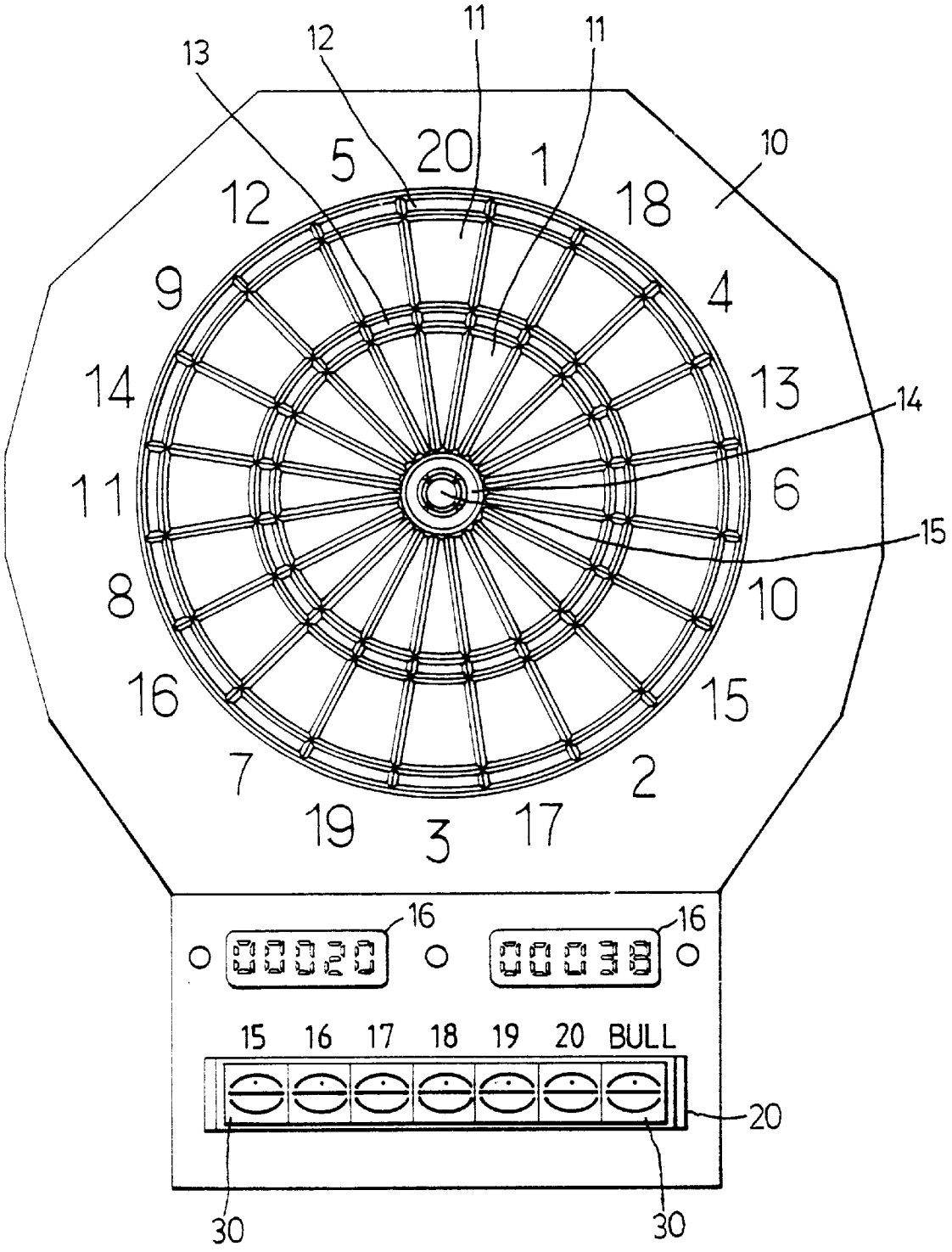
FIG. 1 is a front plane view of a dart game in accordance with the present invention.

Referring to the drawings, and initially to FIG. 1, a dart game in accordance with the present invention is provided for indicating the open status of a cricket game and for warning the other players, and for indicating the close status of a cricket game and for indicating that all the players have shot all three shots of a particular score, with a single displayer.

The dart game comprises a dart board 10 having a number of dart segments provided in the upper portion and having two typical displayers 16 provided in the lower portion for indicating the scoring of the players. The dart board 10 further includes one or more special displayers 20 in the lower portion for indicating the scoring of the players of the cricket dart game. For saving the cost, only one displayer 20 is provided and may show the scores of different players alternatively when a switch is depressed or actuated. In the cricket dart game, the users have to shoot three times for each of the target plates scoring from 15 to 20 and the bull. The segments of the other scoring ranging from 1 to 14 will not be counted. For example, as shown in FIG. 1, when the outermost segment 12 is shot by the dart, the player earns a scoring of double twenty, i.e, forty. The segments 11 each represents a single twenty scoring. The segment 13 represents a triple score. The outer bull 14 represents a scoring of twenty-five, and the inner bull 15 represents double twenty-five, i.e., fifty.

Figure 2:
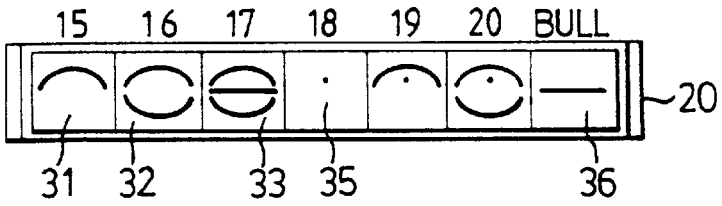
FIGS. 2 and 3 are plane views illustrating the operation of a displayer.
Figure 3:
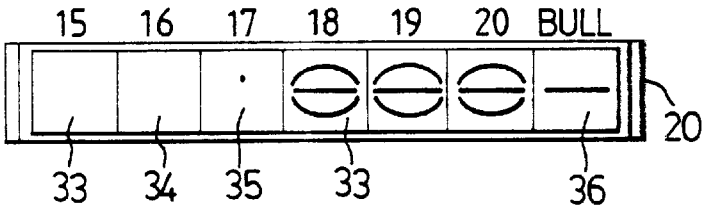

As shown in FIGS. 1 to 3, the displayer 20 is preferably a liquid crystal displayer or is made of light emitting diodes. The displayer 20 includes seven displayer units 30 representing the scoring ranging from 15 to 20 and the scoring of bull (25) respectively.

In operation, FIGS. 2 and 3 are used for explaining the use of the displayers 20. The displayers 20 as shown in FIGS. 2 and 3 show the scoring of two players respectively. The dart board may provide a single 20 for displaying the scorings of one or more players alternatively, and may provide two or more displayers 20 for displaying the scorings of two or more players. For example, the displayer 20 in FIG. 2 is provided for showing the scoring of a first player, and the displayer 20 in FIG. 3 is provided for showing the scoring of a second player. As shown in FIG. 2, the upward curved segment 31 is provided for indicating the first time or first shot of the respective scores. The upward and the downward curved segments 32 indicate that the respective score has been shot for two times. The upward and the downward curved score segments and a horizontal score segment 33 altogether indicate that the respective score has been shot for three times. The blank displayer unit 34 (FIG. 3) indicates that the respective score has not been shot. The dot score segment 35 is a warning sign which will be discussed later. The horizontal score segment 36 indicates a close sign which will also be discussed hereinafter.

As shown in FIG. 2 again, the displayer 20 shows that the first player has shot one (15) and two (16) of the scores. The second player (FIG. 3) shoots none of the (15) and (16) scores. The first player has already shot three times of (17) score, then a dot score segment 35 is shown in the (17) score of the second player (FIG. 3) in order to warn the second player that the first player has already shot all three shots of the (17) score. This is a so-called "open" status. At this moment, the first player may score if he shoots further (17) scores and the second player have to shoot the (17) score quickly. The second player has already shot three times of the (18, 19 and 20) scores such that a dot score segment 35 is provided in each of the (18, 19 and 20) of the first player. At this moment, the second player may score if he shoots further (18, 19 and 20) scores. The scores of (18, 19, 20) are also opened at this moment. FIG. 2 shows that the first player has shot one (19) score and two (20) score only. When both players have shot three times of the bull scores, the horizontal score segment 36 is provided in both of the bull score so as to show the "close" status of the bull score. Nobody may not score any further (25) score when the "close" status has been indicated. The total scores of the players may be shown in the displayers 16 (FIG. 1) .

Figure 4:
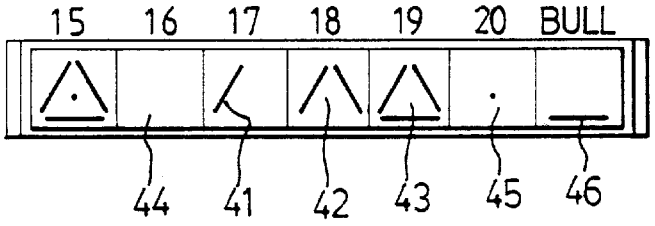
FIG. 4 is a plane view similar to FIGS. 2 and 3, illustrating another application of the displayer.

Similarly, as shown in FIG. 4, a first tapered score segment/41 may be provided for indicating the first shot of the respective scores. The first tapered score segment/and a second tapered score segment\ altogether 42 may be used for indicating that the respective score has been shot for two times. A triangular score segment Δ 43 may indicate that the respective score has been shot for three times. The blank displayer unit 44 indicates that the respective score has not been shot. The dot score segment 45 is a warning sign and the horizontal score segment 46 indicates a close sign.

It is to be noted that the single displayer may show all of the status of the particular scores such that the user may realize the situation of the other players simultaneously with the single displayer and such that the user need not to actuate the buttons frequently in order to view the scores of the other players.

Accordingly, the scoring system for dart games in accordance with the present invention provides a sign for indicating the open status of a cricket game and a sign for indicating the close status and provides another sign for warning the other players.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A score indicating method for a cricket dart game, the dart game including a plurality of dart segments each representing a score, said method comprising:

providing a displayer, said displayer including a plurlaity of score units for indicating a plurlaity of scores each, providing three score segments in each of said score units for indicating three shots of the dart segments, indicating the shots with said score segments of said displayer, providing a warning segment in each of said score units, and indicating a warning signal to the other players with said warning segment of said displayer when a first player has shot at least three times of the score.

2. A score indicating method for a cricket dart game, the dart game including a plurality of dart segments each representing a score, said method comprising:

providing a displayer, said displayer including a plurlaity of score units for indicating a plurlaity of scores each, providing three score segments in each of said score units for indicating three shots of the dart segments, indicating the shots with said score segments of said displayer, providing a close segment in each of said score units, and indicating a close signal to the other players with said close segment of said displayer when all of the players have shot at least three times of the score.

* * * * *